United States Patent [19]

Frauenfeld et al.

[11] Patent Number: 4,649,987

[45] Date of Patent: Mar. 17, 1987

[54] APPARATUS FOR CLEANING THE HEAT-EXCHANGING SURFACES OF THE STORAGE ELEMENTS OF ROTARY REGENERATIVE HEAT EXCHANGERS

[75] Inventors: Martin Frauenfeld, Heidelberg; Georg Goldschmidt, Leimen; Horst Huber, Dossenheim; Karlheinz Mock, Neckargemünd, all of Fed. Rep. of Germany

[73] Assignee: SRM Svenska Rotor Maskiner Aktiebolag, Stockholm, Sweden

[21] Appl. No.: 767,284

[22] PCT Filed: Feb. 21, 1985

[86] PCT No.: PCT/EP85/00058

§ 371 Date: Aug. 16, 1985

§ 102(e) Date: Aug. 16, 1985

[87] PCT Pub. No.: WO85/03768

PCT Pub. Date: Aug. 29, 1985

[30] Foreign Application Priority Data

Feb. 23, 1984 [DE] Fed. Rep. of Germany ..... 3406516

[51] Int. Cl.[4] ..... F28G 9/00

[52] U.S. Cl. ..... 165/5; 165/95

[58] Field of Search ..... 165/5

[56] References Cited

U.S. PATENT DOCUMENTS 3,144,900 8/1964 Stockman ..... 165/5

4,025,362 5/1977 Frauenfeld ..... 165/5

4,141,754 2/1979 Frauenfeld ..... 165/5

FOREIGN PATENT DOCUMENTS 57-82698 5/1982 Japan .....165/5

*Primary Examiner*—Albert W. Davis, Jr.

*Attorney, Agent, or Firm*—Frishauf, Holtz, Goodman & Woodward

[57] ABSTRACT

Apparatus for cleaning the heat-exchanging surfaces of the storage elements of rotary regenerative heat exchangers. The apparatus has a row of nozzles oriented substantially at a tangent and in a radially displaceable manner before the end face of the storage element (1) in the interior of the heat exchanger, which cause the cleaning material, delivered to them from a source of cleaning material, to emerge in an aimed manner onto the storage element (1). The nozzles are provided on at least two spaced-apart nozzle heads (19; 17) disposed a tube (11; 13) extending substantially radially over one half of the end face of the storage element (1), the tube being guided into the interior of the heat exchanger in a sealed manner and being movable by a drive means radially back and forth above the storage element (1). Via movable connecting means, the tube (11; 13) is connected to at least one external, stationary material line delivering the cleaning material. The radially inner nozzle head (19), being adapted to the lesser circumferential speed of the heat exchanger in this vicinity, has a lesser number of nozzles than the next nozzle head (17) in radially outward sequence.

3 Claims, 4 Drawing Figures

APPARATUS FOR CLEANING THE HEAT-EXCHANGING SURFACES OF THE STORAGE ELEMENTS OF ROTARY REGENERATIVE HEAT EXCHANGERS

The invention relates to an apparatus for cleaning the heat-exchanging surfaces of the storage elements of rotary regenerative heat exchangers. The apparatus has at least one row of nozzles disposed beside one another in a substantially tangential orientation and in a radially displaceable manner before the end face of the storage element in the interior of the heat exchanger. The nozzles direct the cleaning material, furnished to them from a source of cleaning material, in an aimed manner onto the storage element.

In order to remove the firmly adhering coating that forms on the heat-exchanging surfaces of storage elements in regenerative heat exchangers during operation and to clean heavily soiled and encrusted heating surfaces, and even conduits in the storage elements that have become completely closed due to soiling, while they are in their installed condition in the storage element carrier but not during operation—that is, during stopped or down times—an apparatus is known in which high-pressure nozzles are disposed in a row, parallel to the plane of the heat-exchanging surfaces, and these nozzles having aimed cylindrical or flat nozzle streams are displaced relative to the plane of the substantially tangentially oriented exchanging surfaces (German Patent DE-PS No. 25 14 173). The high-pressure cleaning nozzles produce sharply defined cleaning streams which strike their target at a point; overall, these streams effect an impacting, beating stress on the heating surfaces, causing firmly adhering, poorly water-soluble encrustations and coatings to be forcibly removed and comminuted. In order to reliably remove the solid contaminants, which are partly insoluble in water, that are loosened or comminuted by the high-pressure nozzles, low-pressure flushing nozzles designed for a relatively high liquid throughput were connected following the high-pressure nozzles and were preferably likewise disposed in a plane parallel to the high-pressure nozzles. The nozzles here are disposed on a carriage, which is moved radially above the end face of the storage elements during the cleaning operation. However, the intensive cleaning process necessitates taking the heat exchangers out of operation during the cleaning.

In a further development of the above known apparatus, it has also already been proposed that injector nozzles for a gas at low or medium pressure, or for a gaseous or vaporous cleaning material, be followed in the direction of the emerging nozzle stream by injector tubes in such a way that these tubes aspirate the enveloping gaseous heat-exchanging medium into the interior of the tube and deliver aimed streams, mixed with the cleaning material, to the through conduits between the heat-exchanging surfaces at a speed profile which is equalized over the injector cross section (German Patent DE-PS No. 26 15 433). The injecting medium here is preferably superheated steam, at a pressure of at least 4 atmospheres above atmospheric pressure and at a temperature of approximately 300° C. In a further development of this embodiment, the injector nozzles were also already followed by a row of high-pressure nozzles, or else the high-pressure nozzles were disposed inside the injector tubes in the vicinity of the outlet of the tubes. Depending on the type of soiling and on the thickness of the coating, which such an apparatus it is possible to perform the loosening and injection operation, on the one hand, for regular daily cleaning to remove light soil, and the high-pressure cleaning operation, on the other, either alone or combined with the injector nozzles, for cleaning at longer intervals to remove heavy soil. When the high-pressure and injector nozzles are used simultaneously, the streams of water produced by the high-pressure nozzles force the coating off the heating surfaces and comminute it, while the gaseous or vaporous cleaning material mixture flushes or blows out the loosened, comminuted coating. The apparatus offers the advantage of both cleaning during operation and flushing of the heating surfaces, including the air flowing through the heat exchanger, or the flue gas, as a flushing medium, because of the injector effect of the flushing medium delivered to the injector nozzles in the form of superheated steam or compressed air.

To clean boiler heating surfaces, on the other hand, so-called soot blowers are known, in which a pair of nozzles is disposed on a blow pipe, with which a cooling flow of water is first delivered through one nozzle to the encrustations and cracks are produced in these encrustations as a result of their becoming brittle and contracting; then a pulsed, high-speed flow is sprayed through the other nozzle, and this water is forced into the cracks that have formed in the encrustation, where the explosive force of the water that is evaporating in the cracks causes the encrustations to flake off (German Patent Disclosure Documents DE-OS No. 32 40 721 and DE-OS No. 32 40 737). One nozzle of each nozzle pair is connected to an outer coaxial tube, and the other is connected to an inner tube, and the blow pipe is supported on a mechanically moved carriage. The nozzles are oriented backward toward the boiler wall, and hose lines are disposed between the connections, fixed on the side toward the room, on the ends of the lines delivering the water used as a cleaning material, and the connections provided on the outer end of the mobile blow pipe. The connection ends of the hose lines are moved toward and away from one another during the movement of the soot blower, so that the extent to which they sag while they are being moved forward in the interior of the boiler varies from a maximum to a minimum. Thus up to an allowable minimum radius of the hose line that is used, the starting position for the course of movement is freely selectable, while the end position of the connections that are moved with the carriage is dependent solely on the length of the hose line used.

In contrast to the above, it is the object of the invention to devise an apparatus for reliably cleaning the storage elements of a rotary regenerative heat exchanger with which, while using small quantities of high-pressure cleaning or flushing material, soiling can be removed during boiler operation; it is intended in principle that it be possible to embody the apparatus such that it can be used selectively for flushing in the medium- and low-pressure range during operation of the heat exchanger, and for flushing in the high- and low-pressure range when the heat exchanger is not in operation.

Based on an apparatus of the generic type described above, this object is attained in accordance with the invention in that the nozzles are provided on at least two spaced-apart nozzle heads disposed [on] a tube extending substantially radially over one half of the end face of the storage element; that the tube, guided in a sealed manner into the interior of the heat exchanger, is guided such that it is radially displaceable back and forth above the storage element and is movable back and forth above the storage element by a drive mechanism, the tube being connected via movable connecting means to at least one of the fixed material lines delivering the cleaning material; and that the radially inner nozzle head has a lesser number of nozzles than the next nozzle head in radially outward sequence. The different number of nozzles on the nozzle heads takes into consideration the fact that a comparatively larger proportion of the storage element surface area is associated with the nozzle head or nozzle heads located radially farther outward. In order to attain a uniformly intensive cleaning and flushing out of the soil from the storage element, this larger proportion of surface area is taken into account by increasing the number of nozzles and hence increasing the quantity of cleaning or flushing material brought to bear. By disposing more than two nozzle heads at equal radial intervals on the tube and appropriately adapting the number of nozzles on each nozzle head, not only can the cleaning effect in the areas of the storage element associated with the nozzle heads be made uniform, but the longitudinal stroke of the tube is shortened accordingly as well, because with an increasing number, a correspondingly narrower annular area of the storage mass is cleaned by each nozzle head.

In a preferred further embodiment of the invention, the tube carrying the nozzle heads is embodied as a double tube, which has, at least in the vicinity of the sealed entry into the interior of the heat exchanger, one inner tube and one outer tube substantially coaxially surrounding the inner tube; the outer tube and the inner tube are connected to separate external material lines, in which cleaning materials of either different types or the same type are delivered at either different pressures or the same pressure, and toward the nozzle head the outer and inner tubes are each connected to separately matched nozzles. The apparatus thus makes it possible to work on the soiled coatings selectively, either separately or together, with smaller quantities of high-pressure liquid cleaning material and/or to perform uniform flushing continuously during operation, using a gaseous or vaporous cleaning material.

In an advantageous further development of the invention the nozzle heads each have a distributor box connected to the outer tube, projecting substantially at right angles to the tube axis of the end face of the storage element and intended for the cleaning material delivered at lower pressure and/or in greater quantity in the outer tube; toward the storage element, the distributor box is closed off by a nozzle plate which carries the associated nozzles.

The nozzles of the nozzle heads associated with the cleaning material delivered via the inner tube, in contrast, are suitably each connected to the inner tube via a branch line guided outside the wall of the outer tube and of the distributor box. The nozzle plate of the distributor box may be augmented by a further nozzle plate, in which a hollow chamber, joined to the branch line, for distributing the cleaning material at higher pressure and/or in smaller quantities to the nozzle or nozzles disposed toward the storage element on the further nozzle plate is embodied.

The movable connecting means are suitably embodied by flexible connecting lines, that is, pressure-resistant hoses, connected at one end to the double tube carrying the nozzle heads and toward the room [to] fixed connections to the material lines; these hoses are guided and/or retained by supporting means in such a manner that their outer end segments extend substantially parallel and in a straight line, while the inner middle segment joining the outer end segments is guided over an approximately semicircular arc.

The supporting means may have a bearing surface, for instance in the form of a profiled bearing rail, each one undercutting or overlapping one of the two outer end segments, guided in parallel straight lines, of the flexible connecting lines; these bearing surfaces or rails guide the segments of the connecting lines, for instance in a vertical plane.

An embodiment which is particularly protective of the flexible connecting lines carrying the cleaning medium is provided with strap elements, which are located in parallel planes on both sides of and beside the connecting lines and are joined pivotably together at their ends in the manner of a chain. Strap elements located on opposite sides of the connecting lines are each joined together in pairs by means of connecting ribs, which respectively undercut or overlap the connecting lines at least in the vicinity of their outer radii of curvature.

The connecting ribs joining the strap elements are embodied such that they secure the flexible connecting lines against lateral displacements, which could for instance be caused by concave or convex curvatures of the connecting ribs as they adapt to the line cross sections.

The connection of the flexible connecting lines to the double tube is simplified, and at the same time a reliable support and guidance of the end of the double tube located outside the heat exchanger is attained by providing that a boxlike collector for the cleaning material or materials is disposed between the connecting lines and the outer end of the double tube. This collector is guided such that it is displaceable back and forth on a rail, for instance sliding on runners or on rollers, in the longitudinal direction of the double tube, and is connected to a drive motor via force transmitting means, such as a chain, spindle or rack. In the case of chain drive, the motor is mounted stationary, while in the case of a rack drive the motor is moved along with the collector, and to this end its electrical supply lines are incorporated into the guidance and support of the flexible connecting lines. The reversal of the direction of movement at the end positions of the advancement of the double tube can be effected via conventional end switches or the like.

A particularly important feature for compensating for thermal stresses is a cantilevered carrier, projecting toward the outside and supported on the jacket of the heat exchanger housing, for retaining the outer end of the tube, the drive means of the tube, and the movable connecting means, that is, the flexible connecting lines.

In regenerative heat exchangers of larger capacity and hence of larger storage element diameter, a radially extending carrier is suitably also disposed in the interior of the regenerative heat exchanger, spaced apart from the end face of the storage element, the segment of the tube nearer the interior of the housing and carrying the nozzle heads being guided in a rolling or sliding manner and retained on this carrier.

The invention is explained in greater detail in the ensuing description of two exemplary embodiments, taken in conjunction with the drawings, in which.

Figure 1:
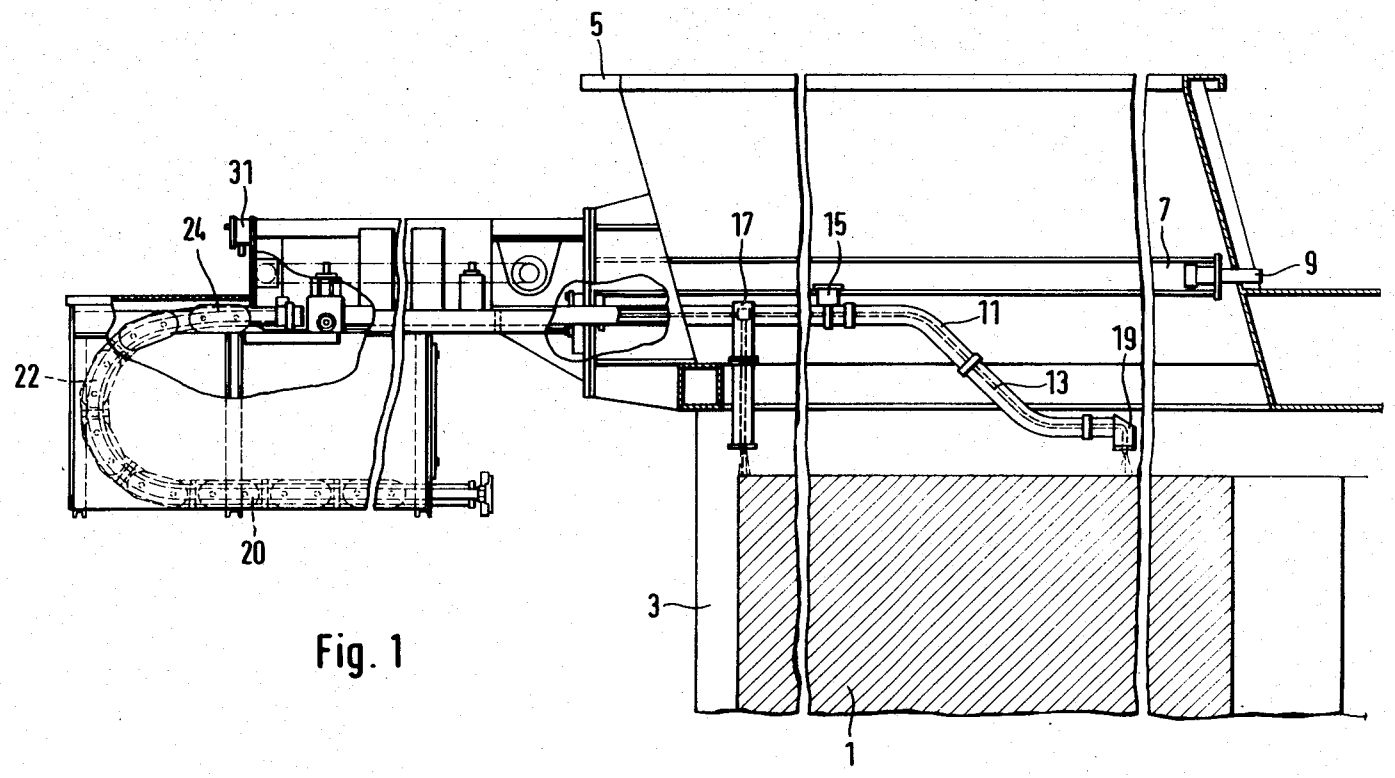
FIG. 1 is a vertical section taken through a portion of a regenerative heat exchanger having a stationary housing and a rotating storage element, on the housing of which the cleaning apparatus according to the invention is mounted.

As shown in the vertical section in FIG. 1, the rotating storage element 1 of the rotary regenerative heat exchanger is surrounded by a housing 3, of which a portion having an inlet or outlet fitting 5 for one of the heat-exchanging, gaseous materials is shown. Protruding into this housing fitting 5, beginning at the housing jacket, is a carrier 7 extending radially in the direction of the axis of rotation of the rotary regenerative heat exchanger. The carrier 7 is slidingly supported on a central guide of the housing 9 and serves to retain and guide a double tube, having an outer tube 11 and an inner tube 13, which is passed through the housing jacket of the preheater such that it is sealed off from the outside. The double tube is guided in a sliding or rolling manner on the supporting arm 7 via supporting means 15. The double tube has two nozzle heads 17, 19. The nozzle head 17 nearer the jacket is shown in the form of a distributor box for a plurality of flushing nozzles, and the nozzle head 19 provided in the vicinity of the axis of rotation of the storage element is shown as a distributor for a pair of nozzles; that is, the nozzle head 17 is provided with a greater number of nozzles than the nozzle head 19. A further carrier 31, also cantilevered outward, is attached to the housing jacket, carrying in its turn the drive means of the cleaning apparatus, the outer guides of the double tube 11, 13 and flexible connecting lines of the cleaning apparatus, having material lines 49, 51 delivering the cleaning material, including a housing enclosing these connecting lines. Each of the connecting lines has end segments 20, 24 guided in a straight line in the housing and one middle segment 22 joining the two end segments in an arc.

Figure 2:
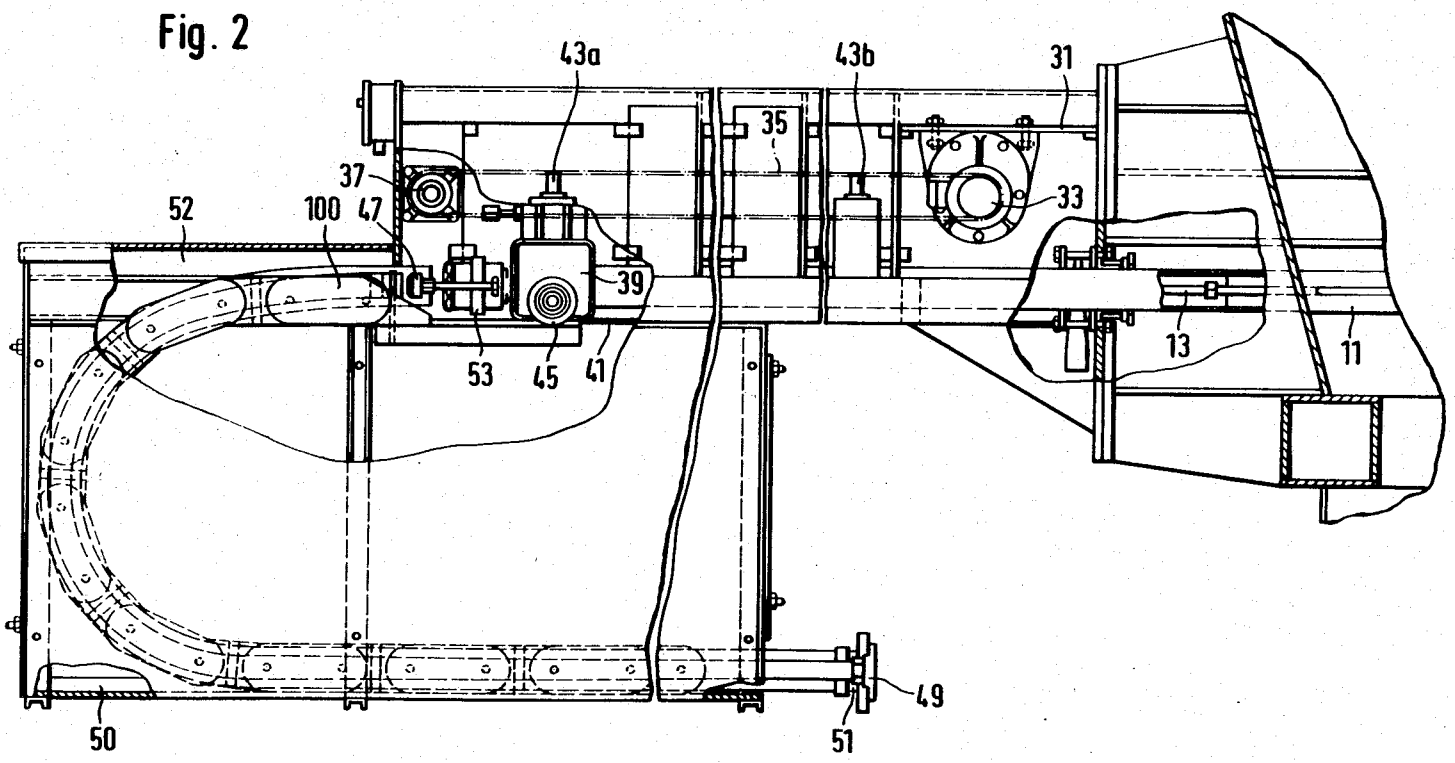
FIG. 2 is a partially cutaway side view of the portion of the cleaning apparatus that is located outside the heat exchanger housing, on an enlarged scale.

In FIG. 2, the portion of the cleaning apparatus disposed outside the heat exchanger housing is shown, on a scale larger than that of FIG. 1. A drive motor 33 is screwed to the carrier 31 and drives a chain 35, which is diverted over a chain wheel retained in the bearing 37. By means of the chain 35, a box-like collector 39 for the lines delivering the cleaning material is moved, as the carrier of the double tube, back and forth on a rail 41 between two end positions, which are determined by the contact 43*a*, disposed in the vicinity of the diverting chain wheel 37, and the contact 43*b* provided on the other end of the stroke path. The collector 39 is provided with rollers 45 which travel on the rail 41. Via a coupling 47, the connection of the associated flexible connecting segment 25 is effected directly onto the inner tube 13, in the axis of the inner tube 13; to this end, the inner tube 13 extends all the way through the collector 39. The other flexible line segment 24, which is joined via the collector to the annular space between the outer and inner tubes, is located, as seen in the drawing, behind the line segment joined to the inner tube and is connected via a coupling 53 to the collector housing and hence to the interior thereof. Via the interior of the collector 39, the cleaning material flows to the outlet side, located opposite the inlet side; the outer tube 11 that coaxially surrounds the inner tube 13 originates at this outlet side.

The above-mentioned housing enclosing the flexible connecting lines has bearing surfaces 50, 52 on its bottom and top, embodied by profiled rails, which undercut and overlap the end segments 20, 24, respectively, of the connecting lines. The connecting lines inside the housing are furthermore guided on both sides by strap elements 100 joined pivotably, in the manner of a chain, to one another at their ends and combined in pairs by connecting ribs (not shown).

Figure 3:
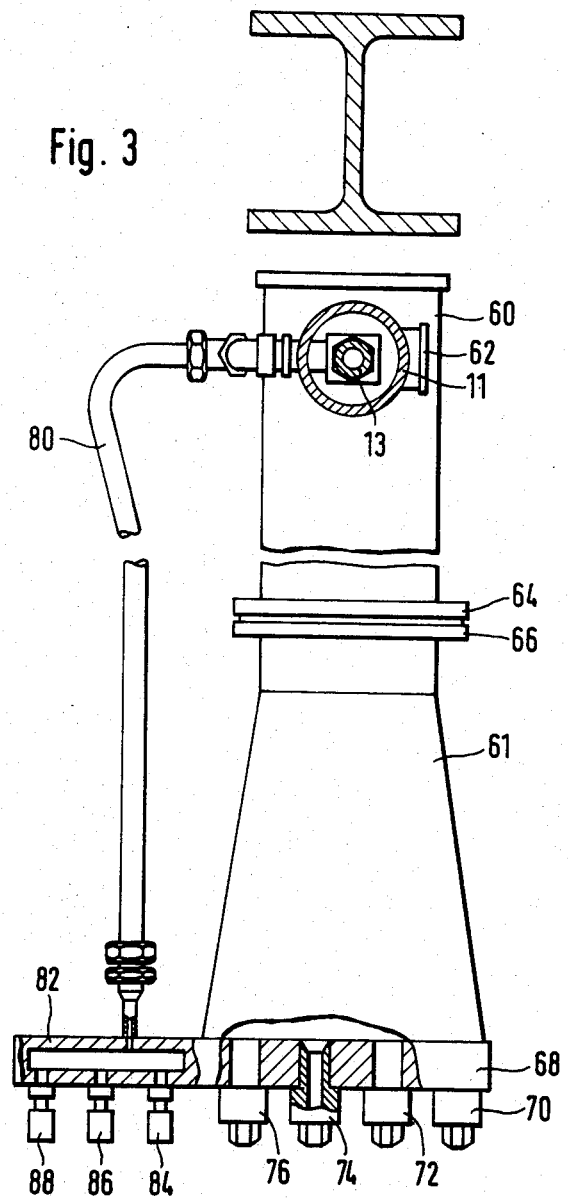
FIG. 3 is a view, in the direction of the longitudinal axis of the double tube, of a nozzle head of the cleaning apparatus.

In FIG. 3, the nozzle head 17, viewed in the axial direction of the double tube 11, 13, is shown on a larger scale than in FIG. 1. The outer tube 11 of the double tube discharges on the front side, as seen in the drawing, of the nozzle head in a distributor box 60, while a segment of the outer tube that delivers the cleaning material to further nozzles is connected to the rear side of the distributor box, as seen in the drawing. The outer tube 11 has a removable lid 62 permitting access to its interior. The distributor box 60 is divided by the flanges 64, 66 into an upper part and a a lower part. The lower part 61 widens conically in the direction of a lower nozzle plate 68. This lower nozzle plate 68 carries, in the present instance, four nozzles 70, 72, 74, 76. A branch line 80 connected to the inner tube 13 leads outward out of the jacket of the outer tube 11, in the vicinity of the removable lid 62 before the distributor box; the branch line 80 carries the cleaning material that has been delivered via the inner tube to a further nozzle plate 82, augmenting the nozzle plate 68 and carring three nozzles 84, 86 and 88. For uniform distribution to the individual nozzles, the nozzle plate 82 is provided in its interior with a hollow chamber by way of which the branch line 80 communicates with the nozzles. In the drawing, the nozzle heads are shown with downwardly pointing nozzles, in association with a storage element disposed beneath the cleaning apparatus. A reversed arrangement can alternatively be realized, in which the portion of the double tube provided inside the housing of the rotary regenerative heat exchanger and including the nozzle heads can, instead of being suspended from a carrier, be guided slidably on this carrier with its nozzle heads and the nozzles on them pointing upward, so as to effect the cleaning of the storage element from the direction of the lower end face.

Figure 4:
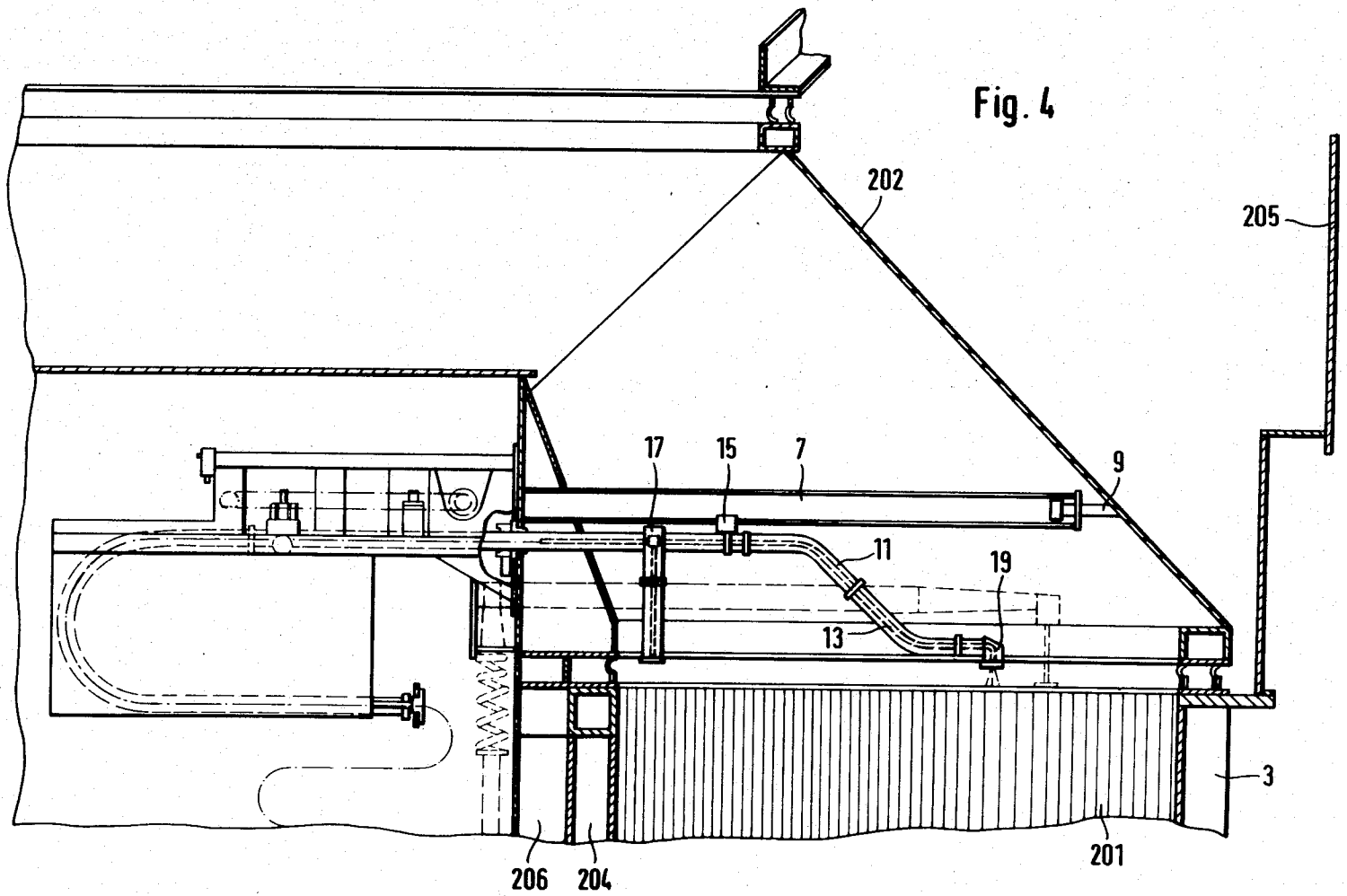
FIG. 4 is a vertical section, similar to that of FIG. 1, through a portion of a regenerative heat exchanger having a stationary storage element and a rotating cap and equipped with a cleaning apparatus according to the invention.

In FIG. 4, the cleaning apparatus in accordance with the invention and intended for heat-exchanging surfaces is shown in connection with a type of rotary regenerative heat exchanger in which, in a kinematic reversal of the circumstances of the heat exchanger shown in FIG. 1, the storage element 201 is stationary, while before its opposed end faces, air conduit fittings 202 for one of the heat-exchanging materials rotate inside the other conduit fitting 205, which is joined to the housing. The carrier 31 disposed outside the storage element 201, in this case disposed centrally, and supporting the cleaning apparatus is, unlike that in FIG. 1, not supported on a jacket 3 enveloping the storage element but rather on a hub tube 206 which rotates inside the hub tube 204 of the storage element carrier supporting the storage element 201 and joining the turn caps 202 to one another in front of the opposing end faces of the storage element. The carrier 7 for supporting the tubes 11, 13 carrying the blowing and flushing material and including the associated nozzle heads 17, 19 is slidably supported on the outer wall of the turn cap 202 via a peripheral guide 9. For further details, it will suffice to refer to the explanation of FIGS. 1 and 2 so as to avoid repetition, especially since like elements in the cleaning apparatus according to the invention and shown in FIGS. 1, 2 and 4 are provided with the same reference numerals.

It will be understood that modifications and further developments of the described exemplary embodiments are realizable within the scope of the inventive concept, in terms of both the number and disposition of the nozzle heads used and the embodiment and three-dimensional disposition of the drive means of the double tube, as well as the location in space of the flexible connecting lines.

What is essential is that with the apparatus according to the invention, cleaning of the storage element can be performed both during operation and during stopped times, and by means of selecting different cleaning or flushing materials at different pressure levels, an adaptation can be made to specialized kinds of soiling. The apparatus according to the invention has particular significance for the operational cleaning of rotary regenerative heat exchangers, which are used for reheating the cleaned gases following scrubbing of the raw gases. In this case, low-pressure blowing is performed during operation, and high-pressure flushing is performed with water, again during operation.

We claim:

1. In apparatus for cleaning the head-exchanging surfaces of the storage elements of rotary regenerative heat exchangers having at least one row of nozzles disposed beside one another, orientated substantially at a tangential direction and in a radially displaceable manner before an end face of a storage element in the interior of the heat exchanger, which nozzles direct the cleaning material, delivered to them from a source of cleaning material, in an aimed manner onto the storage element, wherein the nozzles (70, 72, 74, 76; 84, 86, 88) are provided on at least two radially spaced-apart nozzle heads (19; 17) on a tube arrangement (11; 13) extending substantially radially over one half of the end face of the storage element (1), and the tube arrangement (11; 13) guided in a sealed manner into the interior of the heat exchanger (1, 3, 5) is guided radially above the storage element (1) such as to be displaceable back and forth and is movable back and forth above the storage element (1) by a drive means, the improvement wherein:

the tube arrangement carrying the nozzle heads (19; 17) comprises a double tube connected to the heat exchanger at a sealed entry and including first and second radial tubes (11, 13) connected via external movable connecting means to first and second stationary material lines (49; 51) delivering the cleaning material, each of said radially movable nozzle heads (19; 17) being divided into two laterally separated nozzle plates (69; 82), one of said nozzle plates carrying a first group of nozzles (70–76) and the other of said nozzle plates carrying a second group of nozzles (84–88), said first group of nozzles (70–76) communicating with said first radial tube (11) and said second group of nozzles (84–88) communicating with said second radial tube (13), said first group of nozzles (70–76) providing a different type of cleaning action from said second group of nozzles (84–88), wherein at least in the vicinity of the sealed entry into the interior of the head exchanger, said double tube has said second radial tube (13) and said first radial tube (11) substantially coaxially surrounding said second radial tube, a box-like collector (39) for cleaning material, said box-like collector being disposed between said movable connecting means and an outer end of the double tube (11; 13); and means for movably mounting said box-like collector comprising:

a rail means (41) arranged for carrying said box-like collector (39) and on which said box-like collector (39) is movable in the longitudinal direction of said double tube (11; 13); and force transmitting means (33, 35) coupled to said box-like collector (39) for moving said box-like collector along said rail means (41).

2. Apparatus according to claim 1, wherein said force transmitting means comprises a drive motor (33) and chain means (35) coupling said drive motor to said box-like collector (39).

3. Apparatus according to claim 1, further comprising a cantilevered, outwardly projecting carrier (31) supported on a jacket of the heat exchanger housing (3) for retaining the outer end of the tube (11, 13), its drive means (33, 35, 37) and the movable connecting means.

* * * * *